US007767137B2

(12) United States Patent
Wünsche

(10) Patent No.: US 7,767,137 B2
(45) Date of Patent: Aug. 3, 2010

(54) SEALING APPARATUS FOR A SLAG DOOR OF A METALLURGICAL FURNACE

(75) Inventor: Edgar R. Wünsche, Oshawa (CA)

(73) Assignee: Empco (Canada) Ltd., Whitby, Ontario (CA)

( * ) Notice: Subject to any disclaimer, the term of this patent is extended or adjusted under 35 U.S.C. 154(b) by 454 days.

(21) Appl. No.: 11/765,800

(22) Filed: Jun. 20, 2007

(65) Prior Publication Data

US 2007/0290420 A1 Dec. 20, 2007

Related U.S. Application Data

(60) Provisional application No. 60/805,225, filed on Jun. 20, 2006.

(51) Int. Cl.
*C21C 5/46* (2006.01)

(52) U.S. Cl. ..... 266/135; 266/227; 432/250

(58) Field of Classification Search ..... 266/135, 266/195, 227, 236; 432/250
See application file for complete search history.

(56) References Cited

U.S. PATENT DOCUMENTS 2,664,838 A * 1/1954 Sorensen ..... 432/250
4,570,550 A 2/1986 Wilt
6,415,724 B1 7/2002 Albrecht et al.

FOREIGN PATENT DOCUMENTS

| | | |
|---|---|---|
| CA | 2290925 | 7/2000 |
| JP | 60194015 | 10/1985 |
| JP | 6235590 | 8/1994 |
| WO | WO2006/016201 | 2/2006 |

OTHER PUBLICATIONS

International Search Report of PCT/CA2007/001102.
Informal, non-published, internally prepared English translation of W02006/016201 (previously cited), Feb. 16, 2006.

* cited by examiner

*Primary Examiner*—Scott Kastler
(74) *Attorney, Agent, or Firm*—Bereskin and Parr LLP/S.E.N.C.R.L., s.r.l.

(57) ABSTRACT

A sealing apparatus for a slag door of a metallurgical furnace, having a mounting assembly for mounting the apparatus to the furnace, and at least one closure element, moveable from an open position that is exterior of the slag door opening, to a closed position that effectively seals against the slag door and extends into the slag door opening with the rear panel of the closure element(s) being proximally aligned with the interior wall of the furnace. The apparatus may also have at least one wiping component moveable so as to sweep across the lower surface of the slag door to remove obstructions.

17 Claims, 15 Drawing Sheets

SEALING APPARATUS FOR A SLAG DOOR OF A METALLURGICAL FURNACE

BACKGROUND

The present invention relates to metallurgical furnaces. In particular, the invention relates to metallurgical furnaces of the type having a slag door, such as electric arc furnaces used for steelmaking.

Metallurgical furnaces of the type having a slag door are well known. The slag door is typically positioned on the side of the furnace shell with a tunnel area leading from the furnace interior, and an apron extending below the opening on the exterior of the furnace. The slag door is used for periodic tapping of slag by tipping the furnace, but it is also used for many other operations, including charging of additives, sample collecting, temperature measurement, insertion of burners and oxygen lances, and visual inspection of the furnace interior.

In steelmaking operations, unmolten scrap metal tends to accumulate in the tunnel that extends through the furnace wall from the furnace interior to the slag door opening. Slag can also freeze in large quantities in the area of the tunnel and the threshold of the slag door opening. Commonly, operators must regularly try to clean out these areas by means of tractors equipped with long projecting rams, a technique that has limited efficacy and is also potentially dangerous for the operating personnel.

Known closures for slag doors consist essentially of a sliding panel that can be raised or lowered by a mechanical system of pulleys, sprockets, links and roller chains that is powered by hydraulic or air cylinders. Such closure mechanisms are vulnerable to jamming and blockages, and after being in service for some time, they typically provide only partial coverage of the slag door opening.

As a result, ambient air is sucked into the furnace through the slag door which is believed to lead to a number of drawbacks, including:

heat losses due to excessive volumes of exhaust gas;

excessive pollution in the exhaust gases;

higher energy consumption; and uncontrolled decanting of slag through the slag door.

It is therefore an object of the present invention to address the disadvantages of known metallurgical furnaces having slag doors, or at least to provide a useful alternative.

SUMMARY OF THE INVENTION

In accordance with the first aspect of the present invention, there is provided a sealing apparatus for a slag door of a metallurgical furnace comprising a mounting assembly for mounting the apparatus to the furnace, and at least one closure element having a rear, hot face panel, the closure element being held by the mounting assembly so that it is moveable from an open position that is exterior of the slag door opening, to a closed position that effectively seals against the slag door and in which the closure element extends into the slag door opening with its hot face being proximally aligned with the interior wall of the furnace.

Advantageously, the apparatus also comprises at least one wiping component moveable so as to sweep across the lower surface of the slag door from an open position, remote from the slag door opening, through intermediate positions, to a closed position, within the slag door opening, such that the wiping component can remove obstructions from the lower surface of the slag door.

More advantageously, the wiping component is provided by a pair of opposed, generally horizontally gyrating arms, and the closure element includes a gate mounted so as to be able to move downwardly and inwardly into the slag door opening above the arms. The arms are advantageously independently moveable and water cooled. They may in certain embodiments be controlled by at least one linear or rotary hydraulic actuator.

In certain embodiments, the closure element includes a gate supported by at least one parallelogram linkage mechanism such as the type having a motoring lever connected to a drive shaft, and a follower lever connected between the motoring lever and the closure element. The hot face panel of the gate is advantageously water cooled, and the gate may also include a water cooled bottom panel. In certain embodiments the water cooled bottom panel of the gate is pivotally mounted and can be activated to aid in breaking up and removing obstructions from the slag door.

In certain embodiments, the apparatus also includes a frame positioned exteriorly of the furnace, surrounding the slag door opening, and the closure element rests against the frame in its closed position. The frame is advantageously water cooled.

In other embodiments of the invention, the closure element includes a pair of opposed generally horizontally gyrating doors. The wiping component may be provided by the gyrating doors. The wiping component may also be provided by a panel mounted so as to be able to move downwardly and inwardly into the slag door opening below the doors.

BRIEF DESCRIPTION OF THE DRAWINGS

In order that the invention may be more clearly understood, reference will now be made to the accompanying drawings which illustrate embodiments of the present invention, and in which.

DETAILED DESCRIPTION OF EMBODIMENTS OF THE INVENTION

Figure 1:
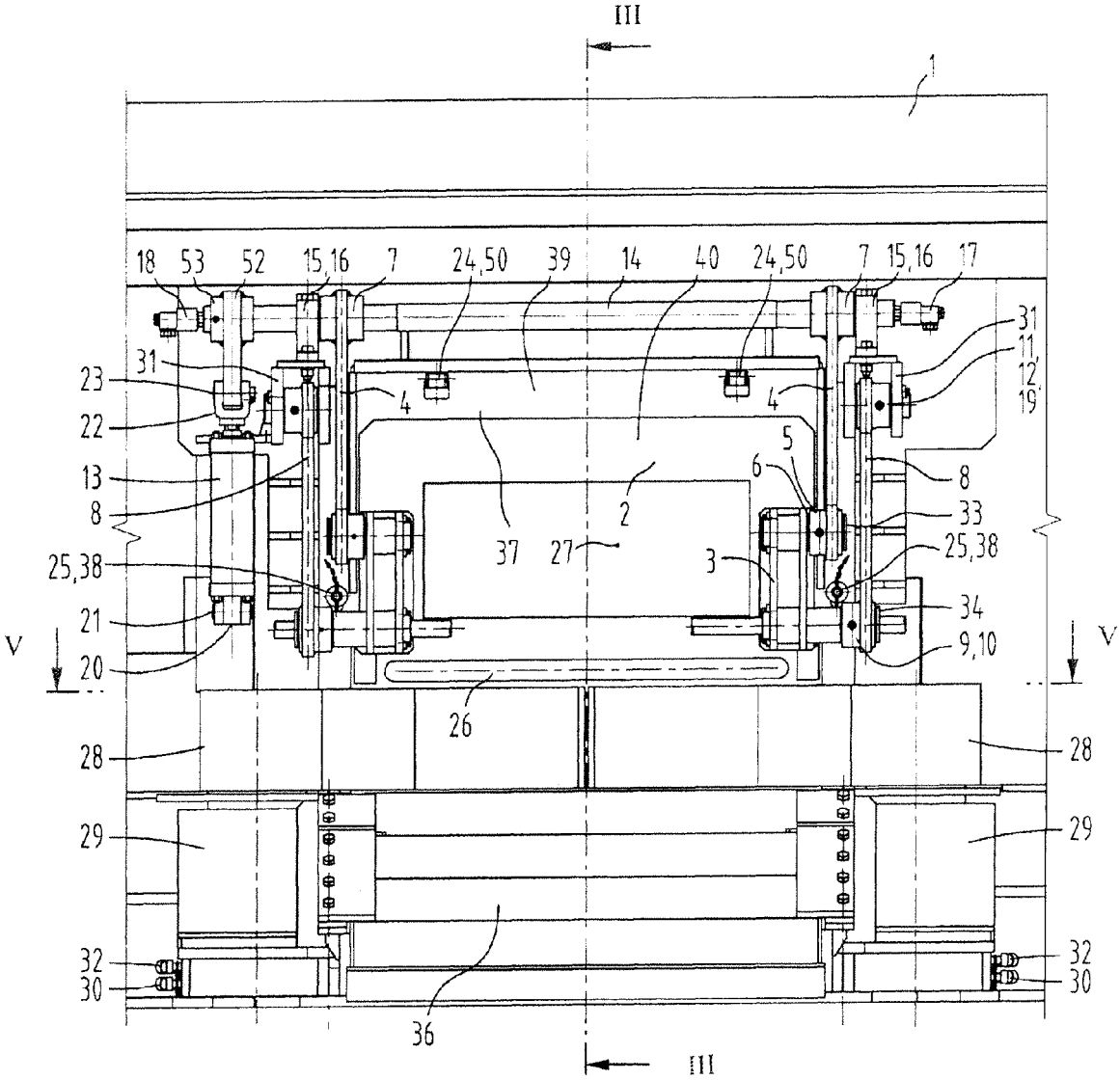
FIG. 1 is a front elevation view of a sealing apparatus for a slag door of a metallurgical furnace according to a first embodiment of the present invention, the apparatus being shown in a fully closed position.

Referring to FIGS. 1-7, particularly FIG. 1, the sealing apparatus has two major component subassemblies, a rotating and retractable centrally located gate 2 controlled by two sets of rotating parallelogram levers (4, 8), and a pair of generally horizontally gyrating flipper arms 28, located below the gate 2.

One end of each of the motoring levers 4 is firmly attached to a driving shaft 14 via double-keyed hubs 7. The other end of each of the motoring levers 4 is equipped with hub 5 and it is dressed with lubricated friction bushing 6. The stabilized end of each follower levers 8 is equipped with hub 11, dressed with lubricated friction bushing 12, rotating around pin 19. The rotating ends of the follower levers 8 are equipped with hubs 9, dressed with lubricated friction bushings 10, rotating around hollow pins 34. The motoring levers 4 are connected to the double-bracket 3 of the gate 2 via pins 33 held firmly in the double-brackets 3. The follower levers 8 are connected to the double-brackets 3 via hollow pins 34, held firmly in the double-brackets 3. The double-brackets 3 are permanently connected to the gate 2.

The water cooled system driving shaft 14 is held and located in position via two pillow blocks 15, equipped with lubricated friction bushings 16. The shaft cooling media—water—is supplied and discharged from the shaft via swiveling joints 17 and 18. The pillow blocks 15 are located on and bolted to the top of brackets 31. The brackets 31 are welded to the furnace shell frame structure 1 and they serve also as base for follower levers 8. The lever 52, equipped with double-keyed hub 53 is attached to one end of the driving shaft 14. An extended end of the lever 52 is connected via clevis 22 and pin 23 to the linear hydraulic cylinder 13, attached to the furnace shell frame structure 1 via welded eye bracket 20 and pin 21.

Each of the two water cooled generally horizontally gyrating flipper arms 28 is carried and rotated by a special hydraulic rotating actuator 29. Rotation of each flipper arm 28 can be independently and/or simultaneously for a desirable angle and is achieved by remote controlled switching of the pressurized and non-pressurized hydraulic fluid via ports 30 and 32 of the hydraulic rotating actuator. A consumable threshold refractory 35 is advantageously extended by long lasting square shaped graphite slabs 36.

An inverted "U" shaped water cooled frame 37 with a sealing flange 39 (shown more clearly in FIG. 3 and FIG. 4) is tightly fitted around the slag door opening and held securely in position by lugs 50 attached to the furnace structure 1, and slotted pins 25 with wedges 38, the pins being permanently attached to the furnace structure 1.

Figure 2:
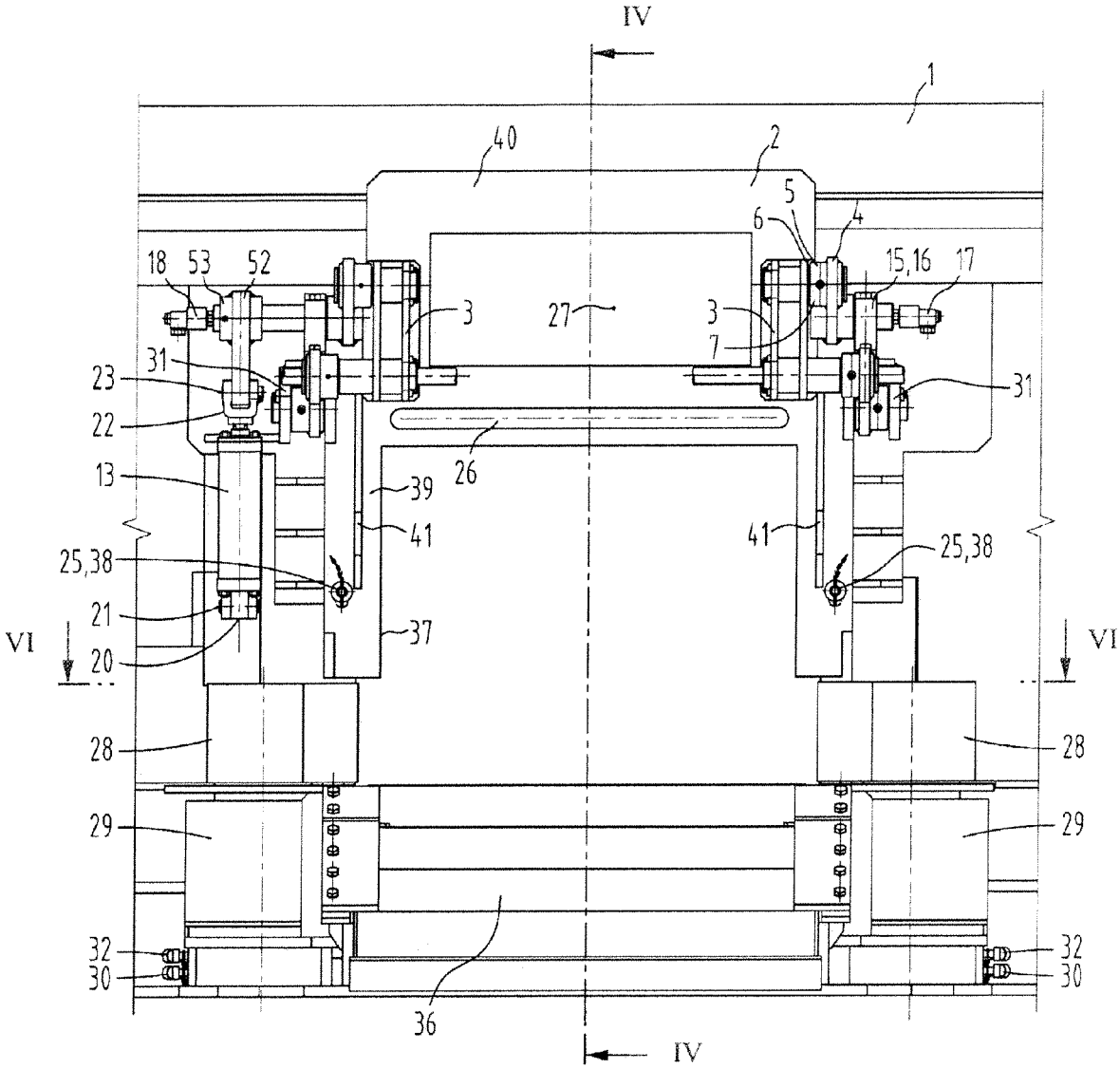
FIG. 2 is a front elevation view of the same sealing apparatus being shown in a fully open position.

Turning to FIG. 2, the sealing apparatus is fully open, with the gate 2 controlled by the two sets of rotating parallelogram 4, 8 and the gyrating flipper arms subassemblies 28 controlled by actuators 29, located below the gate 2. Heat radiation shielding plates 41 provide protection when the gate 2 is in transit between the first, closed position, and the second, open position.

Figure 3A:
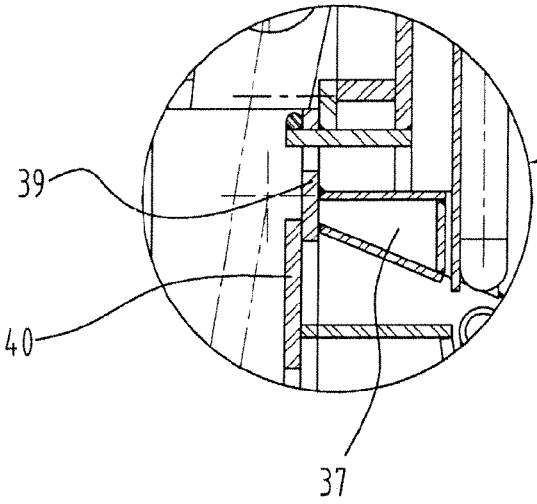
FIG. 3*a* is a close up view of the encircled portion of the sealing apparatus of FIG. 3.
Figure 3:
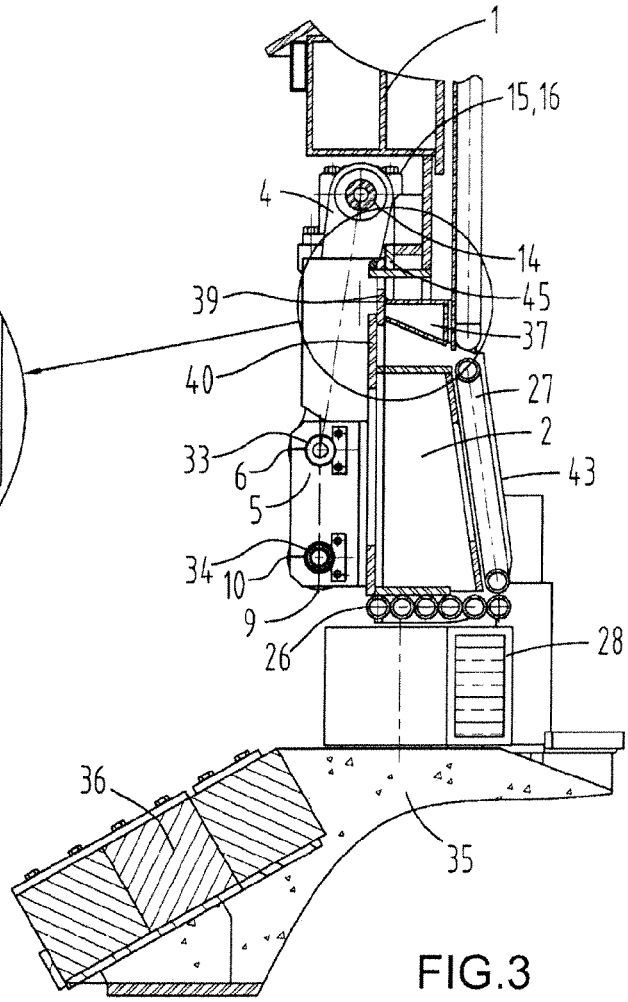
FIG. 3 is a sectional side elevation view of the sealing apparatus of FIG. 1 taken along the line III-III.

Turning to FIG. 3, the gate 2 has water cooled panels 26 and 27, and is held in position by the lever parallelogram mechanism consisting of the two motoring levers 4 and the two follower levers 8;

The water cooled frame 37 allows the rotating and retractable gate 2 to follow composite motion curve with minimum gap between the stationary and moving parts, so that even in intermediary positions there is reduced ingress of cold air into the furnace interior. Also supporting favourable interrelation between stationary and moving components of the gate 2 in closed position is the shape of the water cooled side component 43 of the inverted "U" shape water cooled frame 37. It conforms to the outline and position of the water cooled panel 27; thus when closed it enlarges the flow resistance to the eventually ingressing cold air, and reduces its intake. Moreover, the water cooled hot face panel 27 aligns substantially with the interior wall of the furnace.

The inverted "U" shape water cooled frame 37 with sealing flange 39 (shown more clearly in FIG. 3 and FIG. 4) is tightly fitted into the slag door opening of the furnace shell 1 and held securely in position by square openings 24 in the flange 39 and lugs 50, slotted pins 25 with wedges 38, and elongated holes the pins being permanently attached to the furnace shell 1. When gate 2 is in its fully closed position an inverted "U" shaped peripheral plate 40 is held tightly against the inverted "U" shaped water cooled plate 39 by the fully retracted hydraulic cylinder 13.

The inverted "U" shaped water cooled plate 39 is an intrinsic part of the inverted "U" shape water cooled frame 37. The tightness between items 40 and 39 is assuring that the main purpose of the embodiment of the invention is complied with, that being almost total elimination of the cold air ingress into the furnace inner hot operating chamber.

Remotely controlled extending of the linear hydraulic cylinder 13 invokes rotating motion of the driving shaft 14 and simultaneously parallel rotating motion of the motoring levers 4 and follower levers 8. Since the centrally located gate 2 is connected to the motoring levers 4 and follower levers 8 via double-brackets 3 and pins 33 and 34, the centrally located gate structural subassembly 2 repositions itself in predetermined curved motion from the fully closed position shown in FIGS. 1 and 3 to fully open position shown in FIGS. 2 and 4.

Figures 4, 4A:
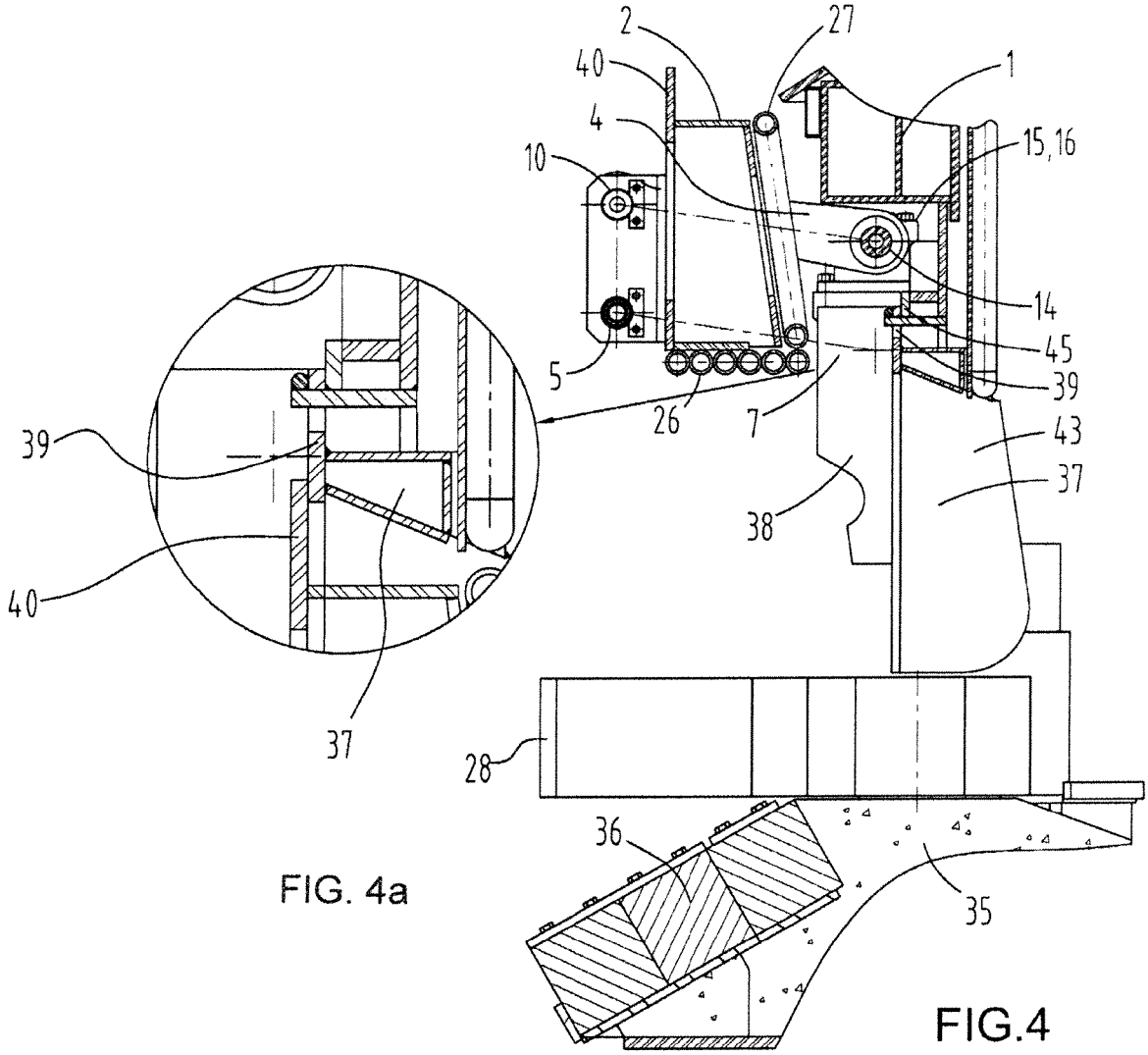
FIG. 4 is a sectional side elevation view of the sealing apparatus of FIG. 2 taken along the line IV-IV.
FIG. 4*a* is a close up view of the encircled portion of the sealing apparatus of FIG. 4.

As seen in FIG. 4, when the gate 2 is fully open, it allows greatly improved access for inspection and eventual repair of the inner of the metallurgical furnace compared to known prior art slag doors.

Figure 5:
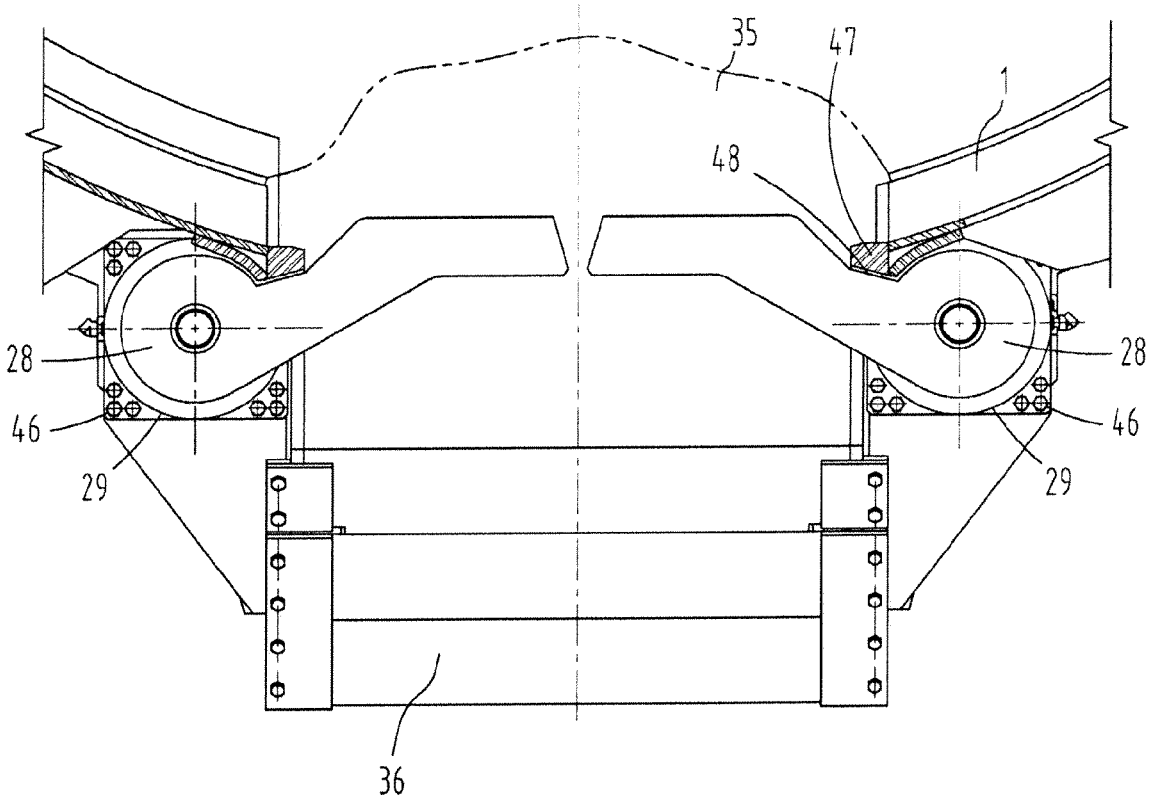
FIG. 5 is a sectional plan view of the sealing apparatus of FIG. 1 taken along the line V-V.
Figure 6:
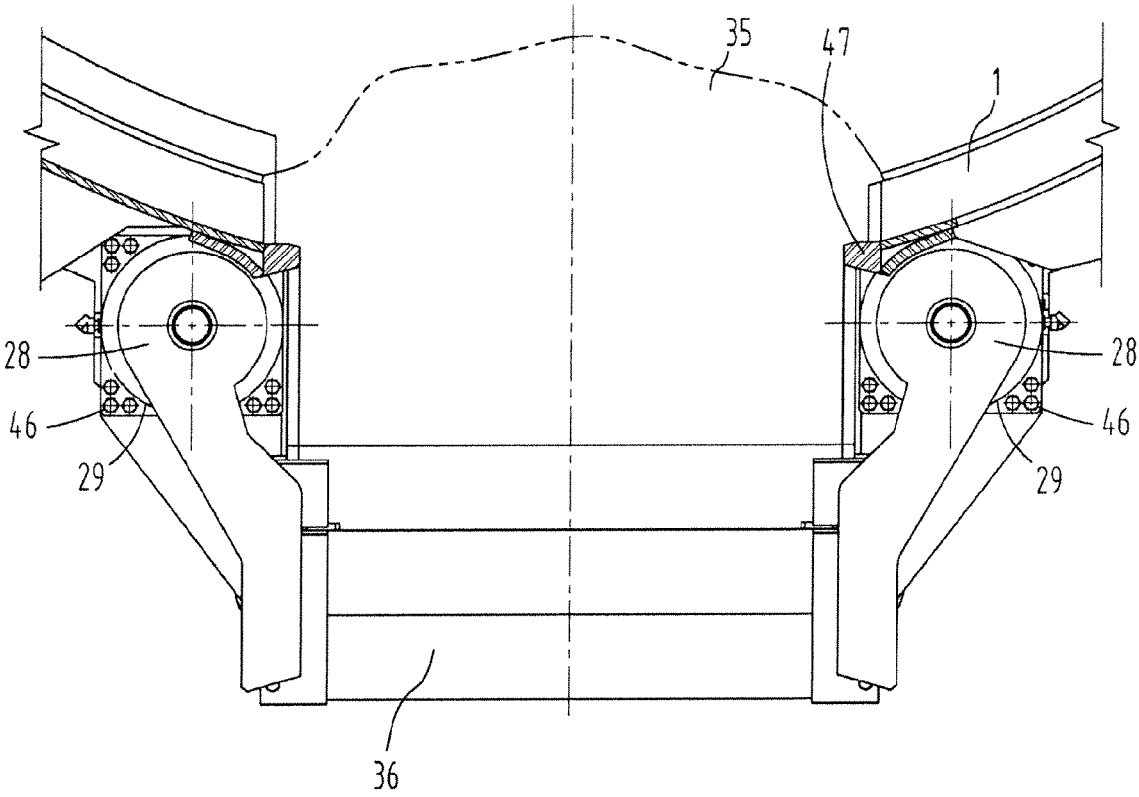
FIG. 6 is a sectional plan view of the sealing apparatus of FIG. 2 taken along the line VI-VI.
Figure 7:
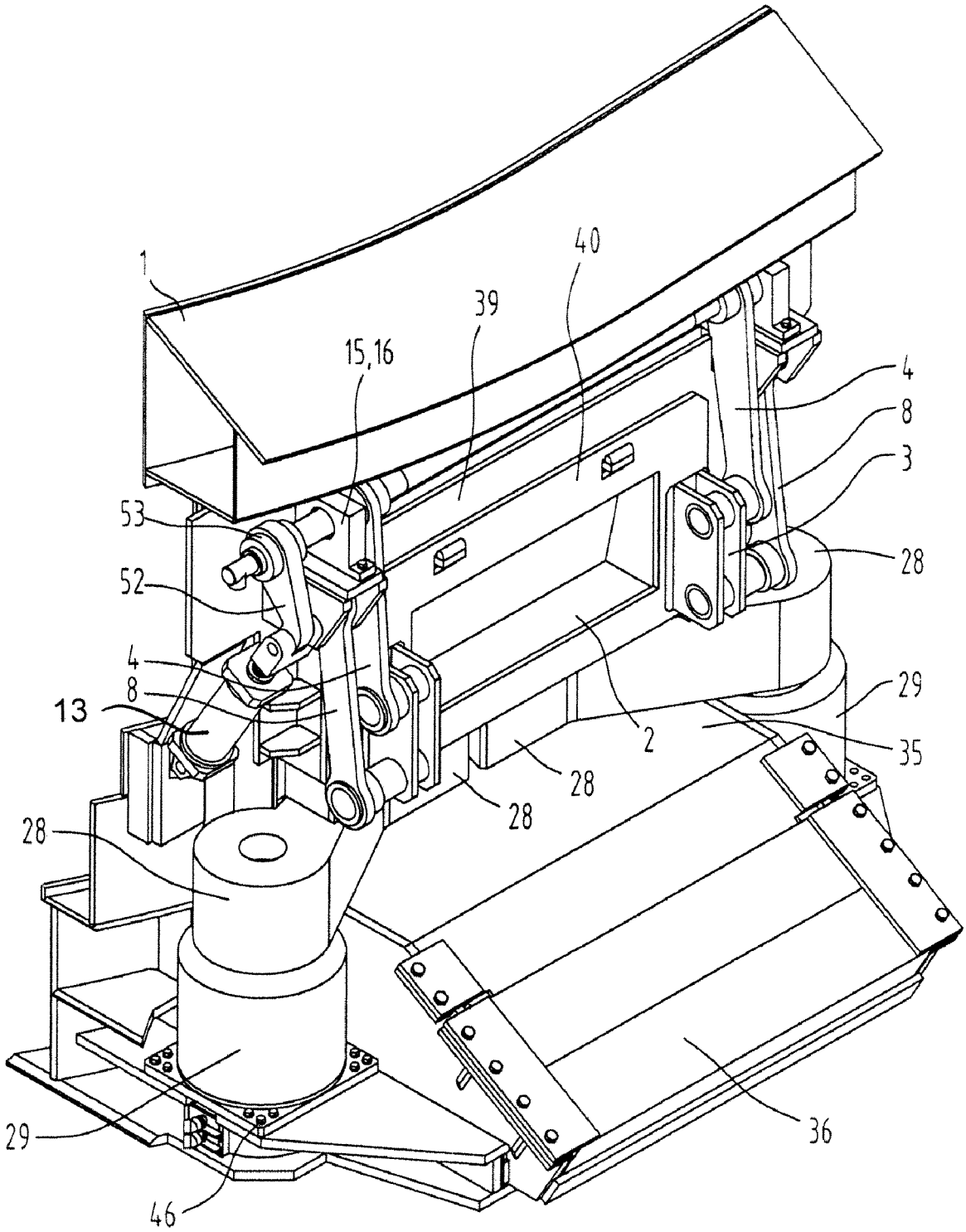
FIG. 7 is an isometric view of the same sealing apparatus shown in a fully closed position.

Turning to FIGS. 5-7, the refractory lining off the furnace bottom 35 is positioned interiorly of the opening. Although the main function of the water cooled generally horizontally gyrating flipper arms 28 is to expediently recondition the threshold refractory 35 by gyrating movement, they also contribute significantly to the sealing effect of the sealing apparatus effectively protecting the furnace interior from excessive ingress of ambient air. The shape of the column 47 of the furnace shell frame, matches the shape of the horizontally gyrating flipper arms 28, leaving only a very small gap 48 between. The rotary hydraulic actuator 29 is water cooled, and is fixed to the furnace shell frame by bolts 46.

Rectangular graphite slabs 36 serve as a non-sticking slag guiding apron. When gyrating flipper arms 28 are held in the closed position, they prevent materials such as liquid steel, liquid and solidified slag and floating refractory to leave freely by overflow of nominal threshold level from the furnace inner operating chamber. Hence, the closed position of the gyrating flipper arms 28 helps retention of more slag in the furnace, significantly contributing to reduction of FeO in the slag leaving the furnace. By gyrating the flipper arms 28 from the closed position through intermediate positions toward the open position, the outflow of slag and other materials can be continuously controlled.

As seen in FIG. 6, when desired, the fully open position of the horizontally gyrating flipper arms 28 allows an unobstructed flow of liquid slag over the nominal level of the threshold refractory.

As seen in FIGS. 1 and 7, a linear hydraulic cylinder 13 is used for control of the parallelogram levers 4, 8, and rotating actuators 29 are used for controlling the gyrating flipper arms 28.

Figure 8:
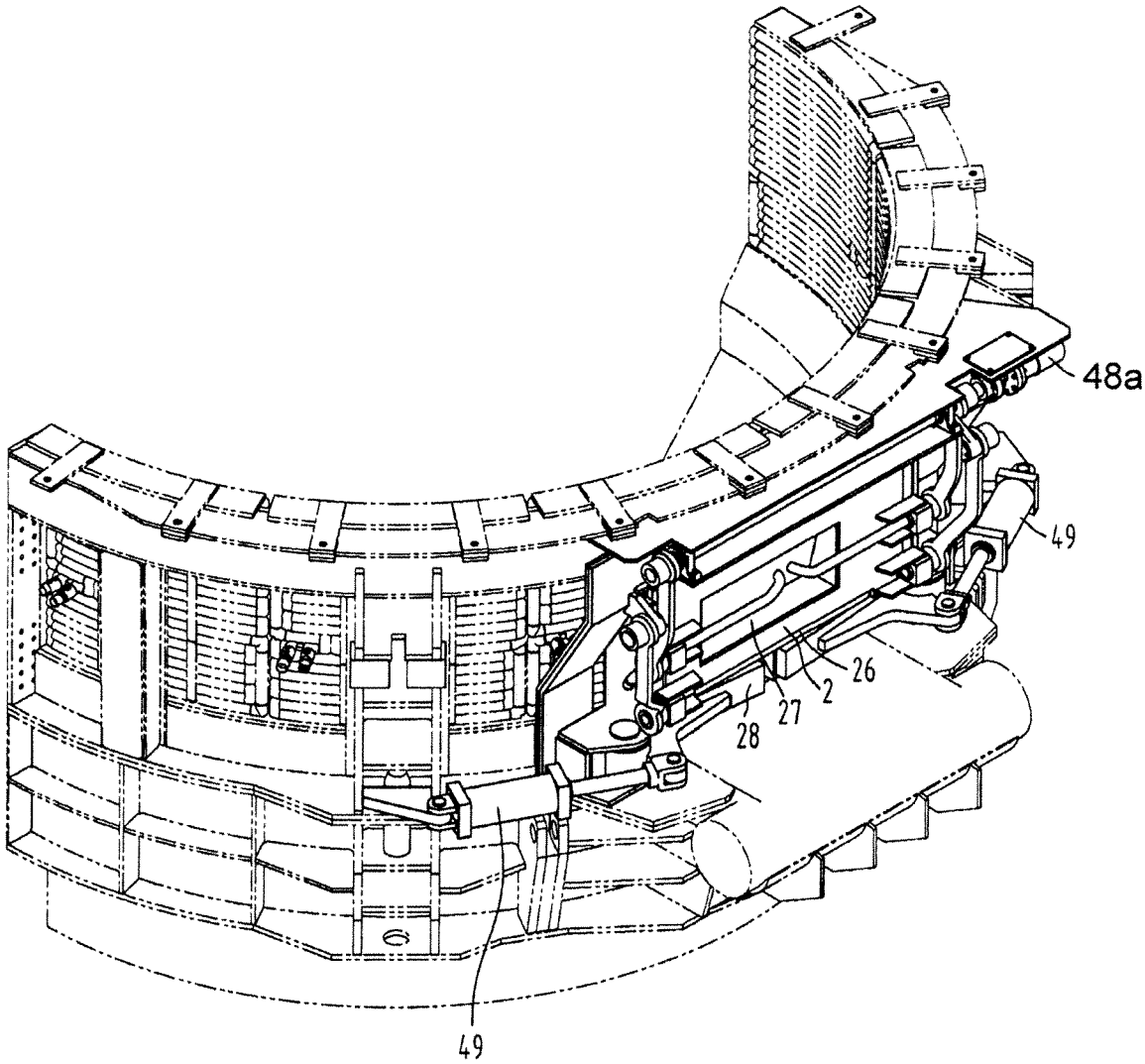
FIG. 8 is an isometric view of a sealing apparatus for a slag door of a metallurgical furnace in accordance with a second embodiment of the present invention, the sealing being shown in conjunction with a portion of the wall of the furnace viewed from the exterior.

In the embodiment of the sealing apparatus shown in FIG. 8, a water cooled rotating actuator 48*a* is used for control of the parallelogram levers 4, 8, and linear hydraulic cylinders 49 are used for controlling the gyrating flipper arms 28.

Figure 9:
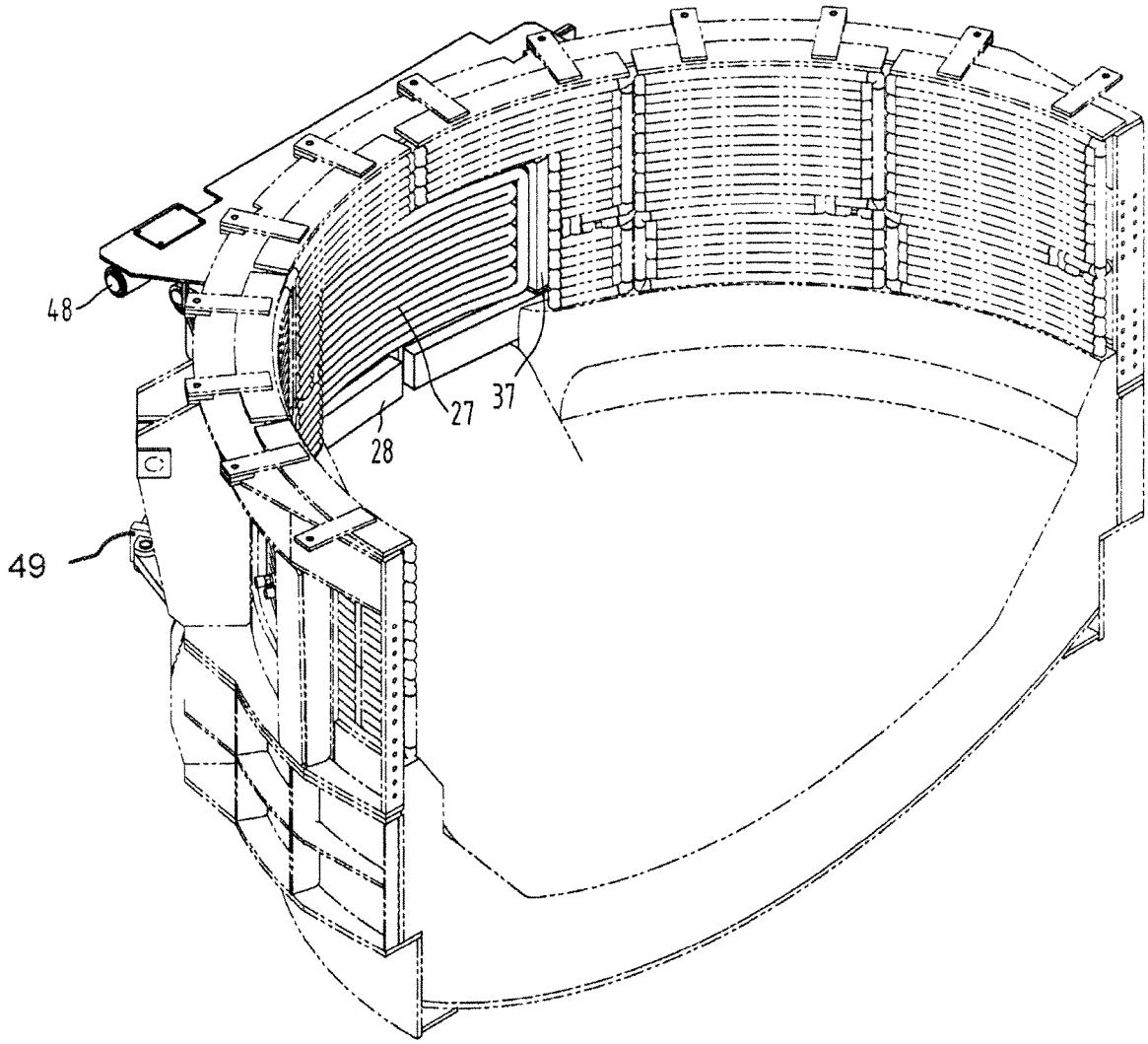
FIG. 9 is an isometric view of the sealing apparatus of FIG. 8 viewed from the interior of the furnace.
Figure 10:
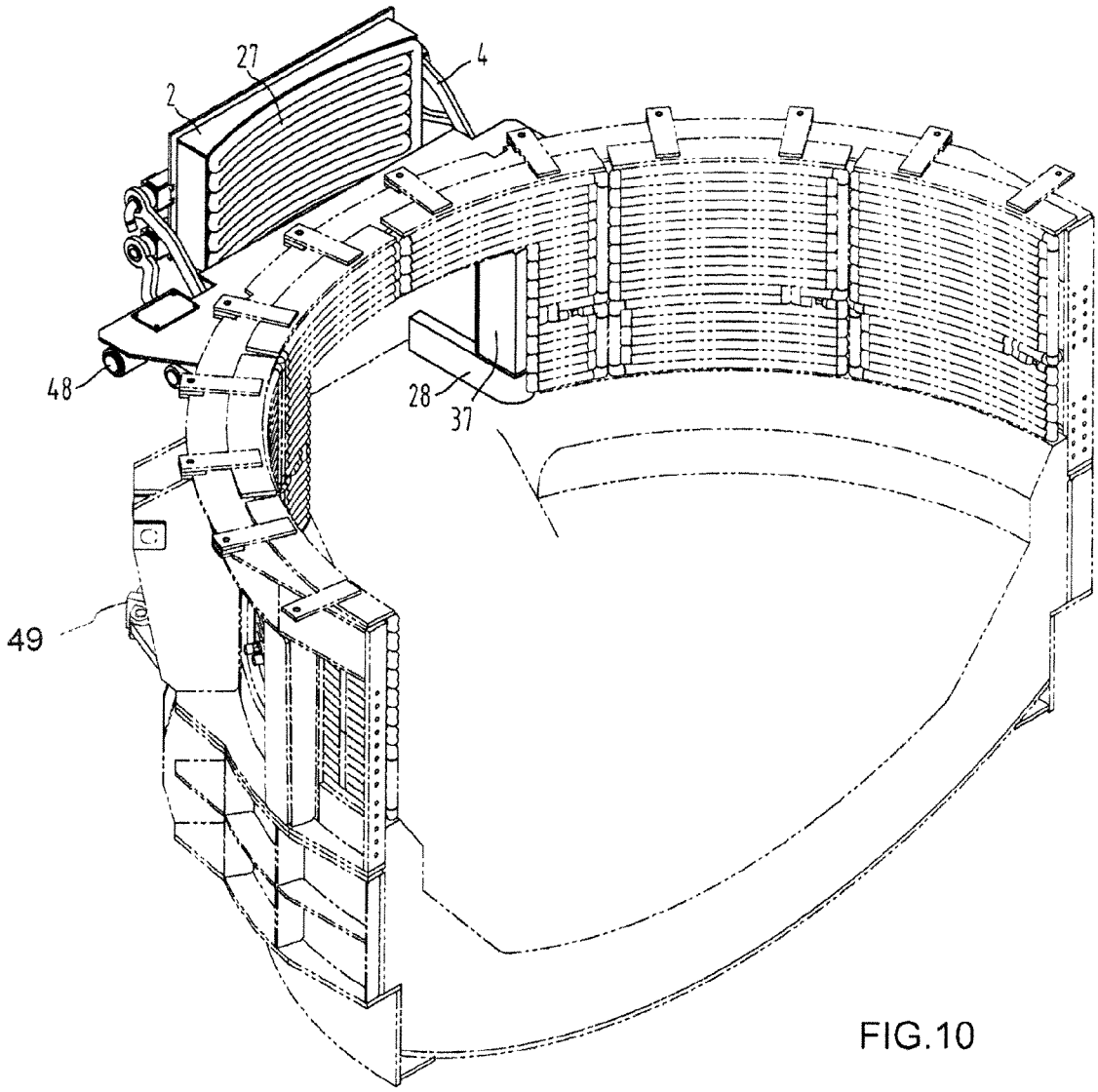
FIG. 10 is an isometric view of the same sealing apparatus shown in a fully open position.

As seen in FIGS. 9 and 10, the sealing apparatus effectively eliminates the void in the furnace walls' water cooled lining in the area of the slag door opening above the slag line, and also effectively eliminates the tunnel leading to the slag door opening. In particular, when the gate 2 is in closed position, the water cooled panel 27 generally aligns with the water cooled panels of the interior furnace wall. The two horizontally gyrating flipper arms 28, whose bottom edges are generally at the level of the sill line of the top ledge of the slag door, effectively fill the opening below the gate 2 with minimal gap.

Figure 11:
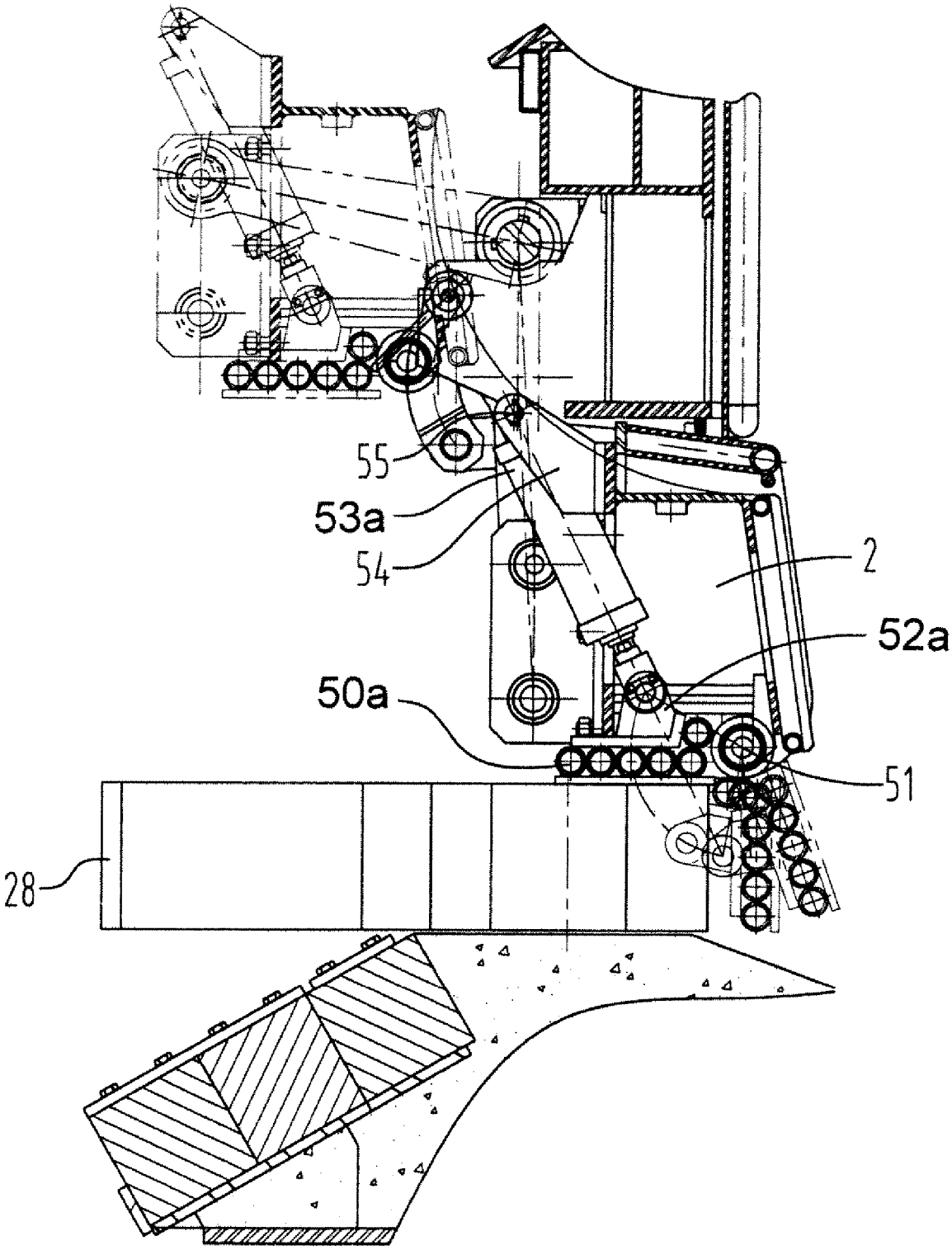
FIG. 11 is a sectional side elevation view of a sealing apparatus for a slag door of a metallurgical furnace in accordance with a third embodiment of the present invention.

In the embodiment of the sealing apparatus shown in FIG. 11 a water cooled panel 50*a* is mounted to the gate 2 rotatable around pivot pins 51. A lever 52*a* is attached to the panel 50 and connected to a hydraulic cylinder 53*a* which is supported by a bracket 54 that is mounted on the gate 2 through a pivot connection 55. The water cooled cleaning panel 50 can provide additional means for breaking up solidified slag in front of the flipper arms 28.

Figure 12:
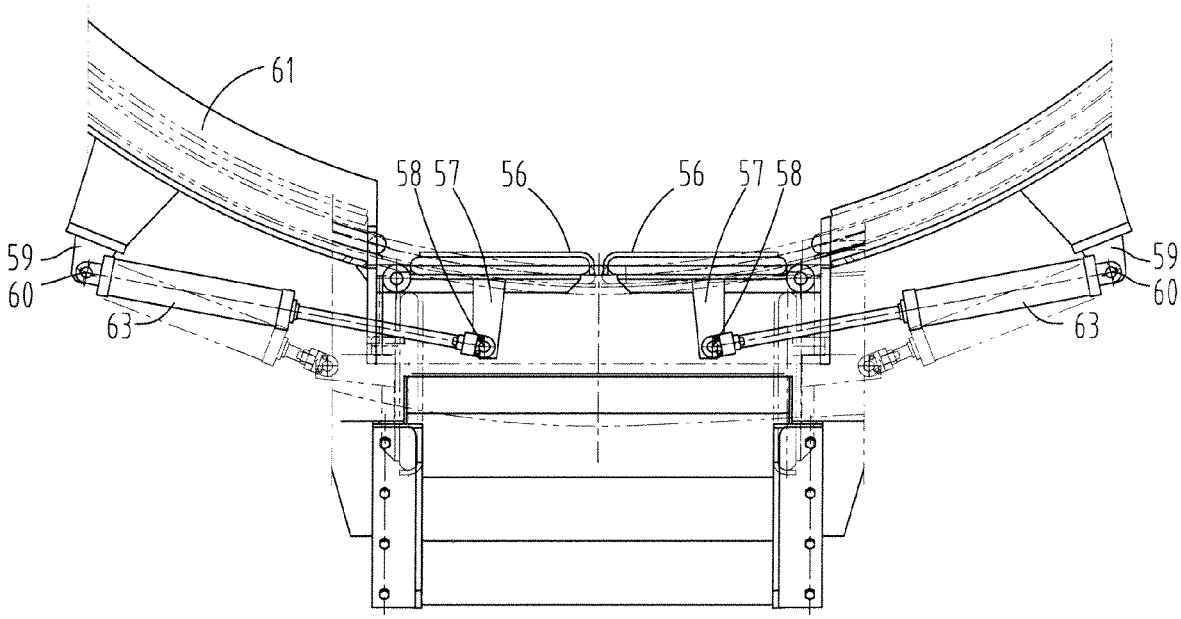
FIG. 12 is a plan view of a sealing apparatus for a slag door of a metallurgical furnace in accordance with a fourth embodiment of the present invention.
Figure 13:
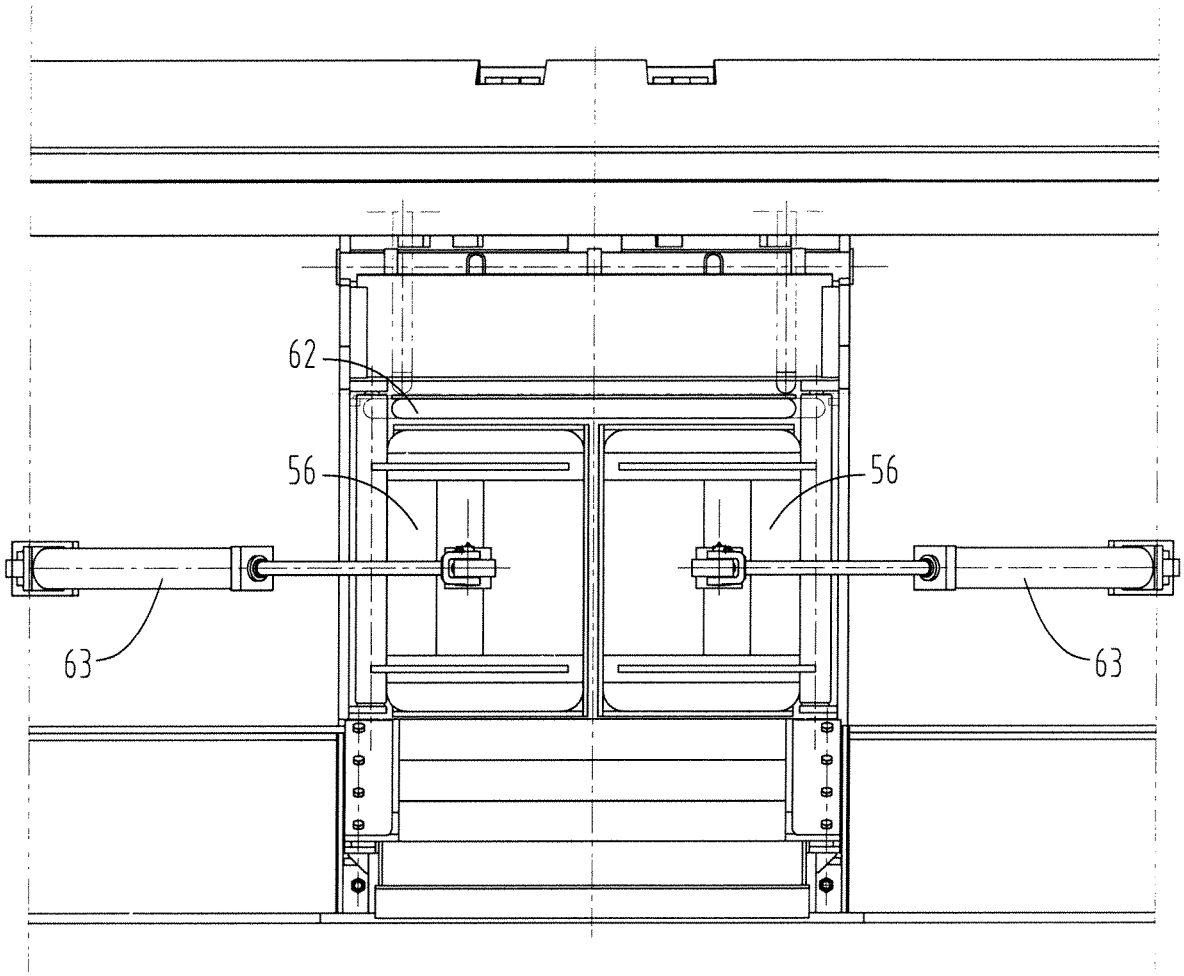
FIG. 13 is a front elevation view of the sealing apparatus of FIG. 12.

In the embodiment of the sealing apparatus shown in FIGS. 12 and 13 the closure element is provided a pair of opposed generally horizontally gyrating doors 56 each being controlled by a connected hydraulic cylinder 63. A lever 57 is attached to each door 56 and connects to the hydraulic cylinder 63 via a pin 58. The hydraulic cylinder, in turn, is supported by a bracket 59 through a pivot 60. The bracket 59 is mounted on the furnace shell 61. The furnace structure is protected in the opening area by a water cooled panel 62.

Figure 14:
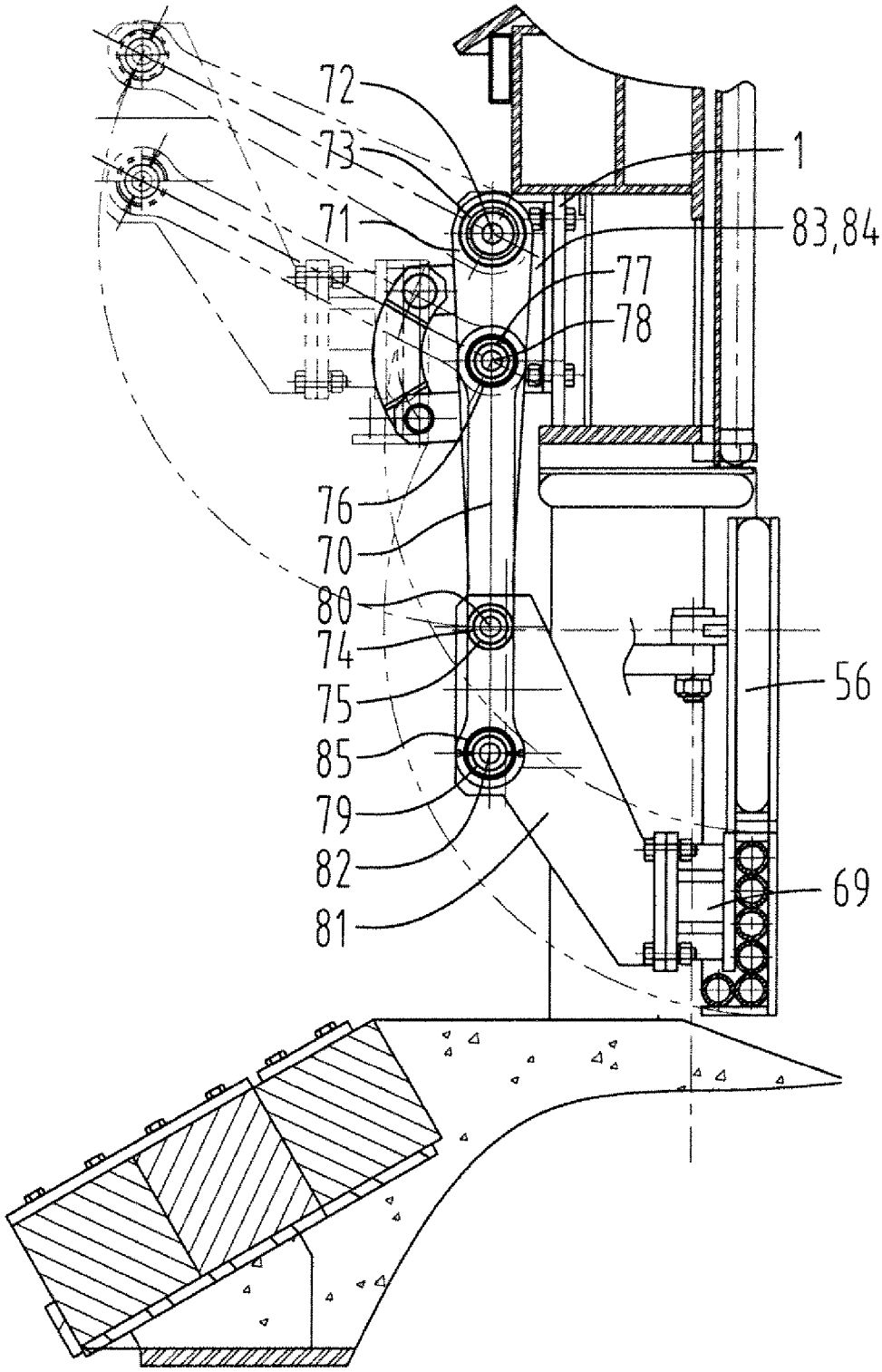
FIG. 14 is a sectional side elevation view of a sealing apparatus for a slag door of a metallurgical furnace in accordance with a fifth embodiment of the present invention.

In the embodiment shown in FIG. 14 there is a also a pair of opposed generally horizontally gyrating doors 56. However, additionally there is a water cooled centrally located panel 69 controlled by a set of rotating parallelogram levers 70, 71. One end of each of the motoring levels 71 is attached to a driving shaft 72 via keyed hubs 73. The other end of each of the motoring levers 71 is equipped with a hub 74 and dressed with a lubricated friction bushing 75.

The stabilized end of each of the follower levers 70 is equipped with a hub 76, dressed with a lubricated friction bushing 77, rotating around a pin 78. The rotating ends of the follower levers 70 are equipped with hubs 85, dressed with a lubricating friction bushing 79, rotating around a pin 82.

The motoring levers 71 are connected to a double bracket 81 of the panel 69 via pins 80 held in the double brackets 81. The follower levers 70 are connected to the double brackets 81 via the pins 82, held in the double brackets 81. The double brackets 81 are connected to the panel 69. The driving shaft 72, which is water cooled, is held and located in position via two pillow blocks 83, equipped with lubricated friction bushings 84. With brackets located on the furnace shell structure 1. The driving shaft 72 is driven either by a hydraulic cylinder or a hydraulic actuator.

Figure 15:
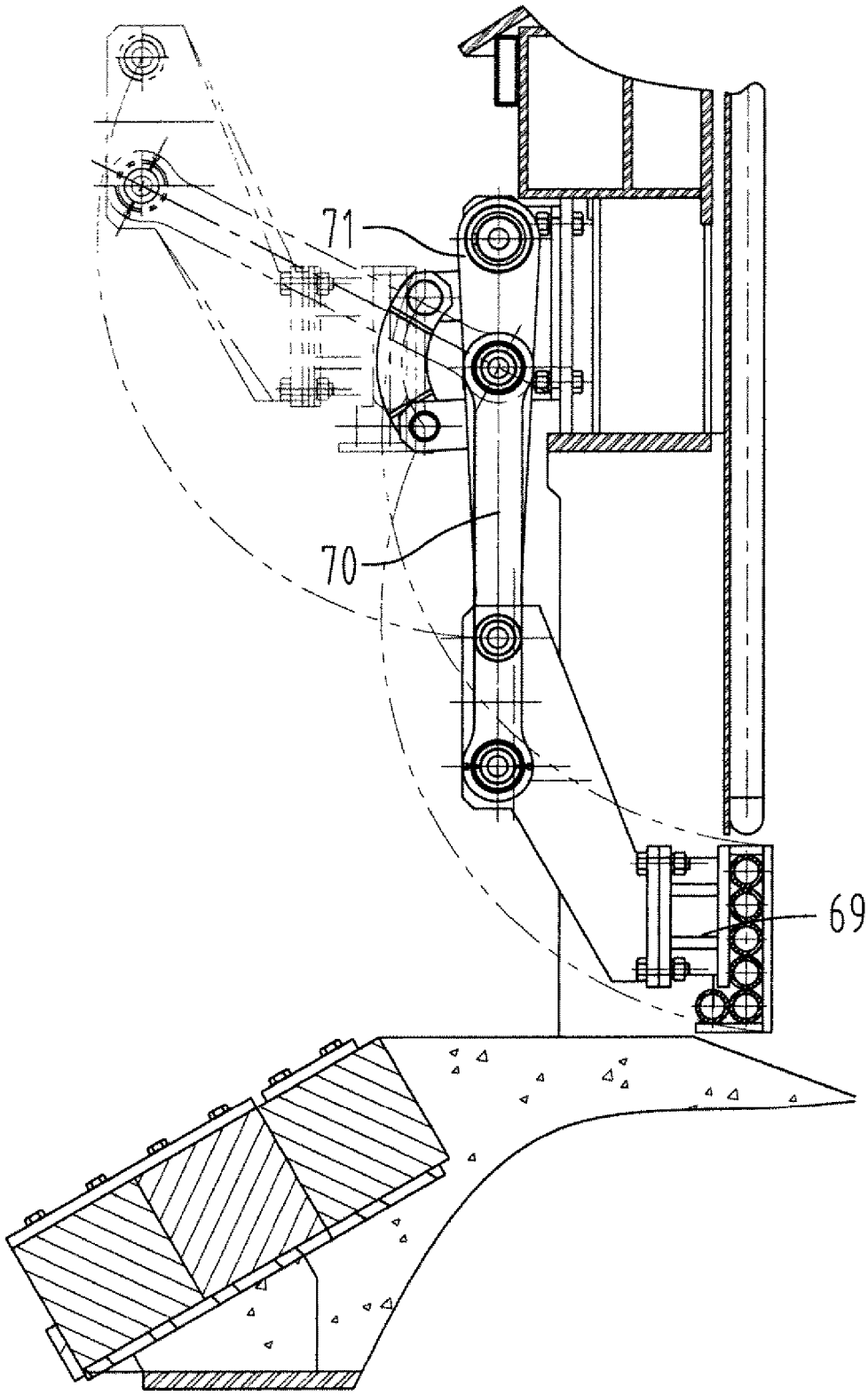
FIG. 15 is a sectional side elevation view of a sealing apparatus for a slag door of a metallurgical furnace in accordance with a sixth embodiment of the present invention.

In the embodiment of the sealing apparatus shown in FIG. 15, the closure is provided by a water cooled centrally located panel 69, controlled by a set of rotating parallelogram levers 70, 71. The structure and operation of the panel 69 is similar to that of the embodiment shown in FIG. 14. However, this embodiment does not include a pair of opposed generally horizontally gyrating doors.

While the above description and accompanying various figures have been made in connection with embodiments of the present invention as presently contemplated by the inventor, it is to be understood that modifications and additions may be made to the described embodiments within the scope of the present invention. Therefore, the present invention should not be considered as being limited to the specific described embodiments, but construed in accordance with the appended claims.

The invention claimed is:

1. A sealing apparatus for a slag door of a metallurgical furnace comprising:

a mounting assembly for mounting said apparatus to the furnace;

at least one closure element having a rear, hot face panel, said at least one closure element being held by said mounting assembly so that it is moveable from an open position that is exterior of the slag door opening, to a closed position that effectively seals against the slag door and in which said at least one closure element extends into the slag door opening with said hot face panel of said at least one closure element being proximally aligned with the interior wall of the furnace;

at least one wiping component moveable so as to sweep across the lower surface of the slag door from an open position, remote from the slag door opening, through intermediate positions, to a closed position, within the slag door opening, such that said at least one wiping component can remove obstructions from the lower surface of the slag door, wherein said at least one wiping component is provided by a pair of opposed, generally horizontally gyrating arms.

2. The apparatus of claim 1 wherein said at least one closure element includes a gate mounted so as to be able to move downwardly and inwardly into the slag door opening above said arms.

3. The apparatus of claim 2 wherein said gate is supported by at least one parallelogram linkage mechanism having a motoring lever connected to a drive shaft, and a follower lever connected between said motoring lever and said at least one closure element.

4. The apparatus of claim 1 wherein said at least one closure element is supported by at least one parallelogram linkage.

5. The apparatus of claim 3 wherein said arms are independently moveable.

6. The apparatus of claim 5, wherein said arms are controlled by at least one rotary hydraulic actuator.

7. The apparatus of claim 3, wherein said hot face panel of said gate is water cooled.

8. The apparatus of claim 7, wherein said gate further comprises a water cooled bottom panel.

9. The apparatus of claim 1, further comprising a frame positioned exteriorly of the furnace, surrounding the slag door opening, and wherein said at least one closure element rests against said frame in said closed position.

10. The apparatus of claim 9, wherein said frame is water cooled.

11. The apparatus of claim 5, wherein said arms are water cooled.

12. The apparatus of claim 8, wherein said water cooled bottom panel is pivotally mounted to said gate and can be activated to aid in breaking up and removing obstructions from the slag door.

13. A sealing apparatus for a slag door of a metallurgical furnace comprising:

a mounting assembly for mounting said apparatus to the furnace;

at least one closure element having a rear, hot face panel, said at least one closure element being held by said mounting assembly so that it is moveable from an open position that is exterior of the slag door opening, to a closed position that effectively seals against the slag door and in which said at least one closure element extends into the slag door opening with said hot face panel of said at least one closure element being proximally aligned with the interior wall of the furnace;

at least one wiping component moveable so as to sweep across the lower surface of the slag door from an open position, remote from the slag door opening, through intermediate positions, to a closed position, within the slag door opening, such that said at least one wiping component can remove obstructions from the lower surface of the slag door, wherein said at least one closure element includes a pair of opposed generally horizontally gyrating doors.

14. The apparatus of claim 13, wherein said wiping component is provided by said gyrating doors.

15. The apparatus of claim 13, wherein said wiping component is further provided by a panel mounted so as to be able to move downwardly and inwardly into the slag door opening below said doors.

16. A sealing apparatus for a slag door of a metallurgical furnace comprising:

a mounting assembly for mounting said apparatus to the furnace;

at least one closure element having a rear, hot face panel, said at least one closure element being held by said mounting assembly so that it is moveable from an open position that is exterior of the slag door opening, to a closed position that effectively seals against the slag door and in which said at least one closure element extends into the slag door opening with said hot face panel of said at least one closure element being proximally aligned with the interior wall of the furnace;

at least one wiping component moveable so as to sweep linearly and substantially horizontally across the lower surface of the slag door from an open position, remote from the slag door opening, through intermediate positions, to a closed position, within the slag door opening, such that said at least one wiping component can remove obstructions from the lower surface of the slag door.

17. The apparatus of claim 16 wherein said at least one closure element includes a gate element mounted so as to be able to move downwardly and inwardly into the slag door opening.

* * * * *